US011913650B2

(12) United States Patent
Zhu et al.

(10) Patent No.: US 11,913,650 B2
(45) Date of Patent: Feb. 27, 2024

(54) AIR CONDITIONER INDOOR UNIT

(71) Applicant: GD MIDEA AIR-CONDITIONING EQUIPMENT CO., LTD., Foshan (CN)

(72) Inventors: Maocheng Zhu, Foshan (CN); Shengqi Li, Foshan (CN)

(73) Assignee: GD MIDEA AIR-CONDITIONING EQUIPMENT CO., LTD., Foshan (CN)

( * ) Notice: Subject to any disclaimer, the term of this patent is extended or adjusted under 35 U.S.C. 154(b) by 374 days.

(21) Appl. No.: 16/776,784

(22) Filed: Jan. 30, 2020

(65) Prior Publication Data

US 2020/0166222 A1 May 28, 2020

Related U.S. Application Data

(63) Continuation of application No. PCT/CN2018/084926, filed on Apr. 27, 2018.

(30) Foreign Application Priority Data

Jul. 31, 2017 (CN) ..... 201710642952.7
Jul. 31, 2017 (CN) ..... 201720948669.2

(51) Int. Cl.
*F24F 1/0011* (2019.01)
*F24F 13/14* (2006.01)

(52) U.S. Cl.
CPC ..... *F24F 1/0011* (2013.01); *F24F 13/14* (2013.01)

(58) Field of Classification Search
CPC ..... F24F 1/0011; F24F 1/14; F24F 1/00075; F24F 5/0017; F24F 5/0089; F24F 13/04; F24F 13/068; F24F 5/0021; F24F 5/0092; F24F 2221/14; F24D 3/16
See application file for complete search history.

(56) References Cited

U.S. PATENT DOCUMENTS 6,942,563 B2 * 9/2005 Pesch ..... F24F 13/06 454/284
2015/0096723 A1 * 4/2015 Jeong ..... F25D 17/06 165/121
2016/0327297 A1 * 11/2016 Song ..... F24F 1/0022
(Continued)

FOREIGN PATENT DOCUMENTS

CN 2731543 Y 10/2005
CN 103776093 A 5/2014
(Continued)

OTHER PUBLICATIONS

CN2731543Y mt (Year: 2004).*
(Continued)

*Primary Examiner* — Gordon A Jones
(74) *Attorney, Agent, or Firm* — Anova Law Group, PLLC

(57) ABSTRACT

An air conditioner indoor unit includes a body including an air outlet, an outer air deflector located at the air outlet and configured to open and close the air outlet, and an inner air deflector located at an inner side of the outer air deflector and configured to expose and cover at least part of the outer air deflector. The outer air deflector includes a plurality of vent holes penetrating the outer air deflector along a thickness direction of the outer air deflector.

17 Claims, 10 Drawing Sheets

(56) References Cited

U.S. PATENT DOCUMENTS

| | | | | |
|---|---|---|---|---|
| 2018/0142129 | A1* | 5/2018 | Yamamoto | C09D 201/04 |
| 2018/0172288 | A1* | 6/2018 | Kim | F24F 1/0014 |
| 2018/0313552 | A1* | 11/2018 | Lee | F24F 13/14 |
| 2020/0018512 | A1* | 1/2020 | Wang | F24F 11/79 |

FOREIGN PATENT DOCUMENTS

| | | | | | |
|---|---|---|---|---|---|
| CN | 203642435 | U | | 6/2014 | |
| CN | 104676758 | A | | 6/2015 | |
| CN | 104676864 | A | | 6/2015 | |
| CN | 104697055 | A | | 6/2015 | |
| CN | 204555023 | U | | 8/2015 | |
| CN | 204555027 | U | | 8/2015 | |
| CN | 204555028 | U | | 8/2015 | |
| CN | 105003965 | A | | 10/2015 | |
| CN | 105020848 | A | | 11/2015 | |
| CN | 204786798 | U | | 11/2015 | |
| CN | 204786798 | U | * | 11/2015 | |
| CN | 105135519 | A | | 12/2015 | |
| CN | 204901976 | U | | 12/2015 | |
| CN | 106152270 | A | | 11/2016 | |
| CN | 106369797 | A | | 2/2017 | |
| CN | 106949541 | A | | 7/2017 | |
| CN | 106949615 | A | | 7/2017 | |
| CN | 107327931 | A | | 11/2017 | |
| CN | 206618019 | U | * | 11/2017 | |
| CN | 207146543 | U | | 3/2018 | |
| CN | 108954762 | A | * | 12/2018 | F24F 1/0003 |
| DE | 2351232 | A1 | * | 4/1973 | F24F 13/12 |
| EP | 1637815 | A1 | | 3/2006 | |
| EP | 1804003 | A1 | | 7/2007 | |
| JP | 61237957 | A | | 10/1986 | |
| JP | 2002277038 | A | | 9/2002 | |
| JP | 2005090927 | A | | 4/2005 | |
| JP | 2005257192 | A | | 9/2005 | |
| JP | 2015206495 | A | | 11/2015 | |
| KR | 20080060845 | A | | 7/2008 | |

OTHER PUBLICATIONS

DE2351232A1 mt (Year: 1973).*
CN-108954762-A mt (Year: 2018).*
CN-206618019-U mt (Year: 2017).*
CN 204786798 U mt (Year: 2015).*
Intellectual Property Australia (IPA) The Office Action for Australia Application No. 2018311607 dated Nov. 3, 2020 4 Pages.
Intellectual Property Japan (IPJ) The Office Action for JP Application No. 2019-543218 dated Sep. 1, 2020 11 Pages (Translation Included ).
The European Patent Office (EPO) Extended Search Report for EP Application No. 18841222.5 dated Apr. 3, 2020 9 Pages.
World Intellectual Property Organization (WIPO) International Search Report for PCT/CN2018/084926 dated Jun. 29, 2018 6 Pages.
The State Intellectual Property Office of PRC (SIPO) The First Office Action for CN Application No. 201810418718.0 dated May 13, 2019 10 Pages (Translation Included ).
The State Intellectual Property Office of PRC (SIPO) The Second Office Action for CN Application No. 201810418718.0 dated Dec. 18, 2019 11 Pages (Translation Included ).
The State Intellectual Property Office of PRC (SIPO) The First Office Action for CN Application No. 202010097177.3 dated Dec. 3, 2020 15 Pages (Translation Included ).
The State Intellectual Property Office of PRC (SIPO) The First Office Action for CN Application No. 202010096118.4 dated Dec. 17, 2020 23 Pages (Translation Included ).
Korean Intellectual Property Office (KIPO) The Office Action for KR Application No. 10-2020-7002784 dated Jun. 21, 2021 8 Pages (Translation Included ).
The State Intellectual Property Office of PRC (SIPO) The First Office Action for CN Application No. 201710642952.7 dated Mar. 27, 2019 13 Pages (Translation Included ).
The State Intellectual Property Office of PRC (SIPO) The Second Office Action for CN Application No. 201710642952.7 dated Nov. 20, 2019 8 Pages (Translation Included ).
The State Intellectual Property Office of PRC (SIPO) The First Office Action for CN Application No. 201810395745.0 dated Apr. 18, 2019 16 Pages (Translation Included ).
The State Intellectual Property Office of PRC (SIPO) The Second Office Action for CN Application No. 201810395745.0 dated Jan. 7, 2020 14 Pages (Translation Included ).

* cited by examiner

AIR CONDITIONER INDOOR UNIT

CROSS-REFERENCE TO RELATED APPLICATIONS

This application is a continuation of International Application No. PCT/CN2018/084926, filed Apr. 27, 2018, which claims priority to Chinese Application Nos. 201710642952.7 and 201720948669.2, both filed Jul. 31, 2017, the entire contents of all of which are incorporated herein by reference.

FIELD

The present disclosure relates to a technical field of household appliances, and more particularly to an air conditioner indoor unit.

BACKGROUND

With the improvement of living standard, consumers have attached an increasing importance to user experience of goods. In terms of air conditioner, comfortable experience is required in addition to cooling and heating. The users usually turn on the air conditioner for cooling in hot summer, but it is not comfortable if the cold wind directly blows toward them. Some physically weak people, including elders, pregnant women, and children, are vulnerable to disease related to air conditioning.

SUMMARY

The present disclosure aims to address at least one of the technical problems existing in the related art. To this end, the present disclosure proposes an air conditioner indoor unit, which can achieve a windless effect.

The indoor unit according to the present disclosure includes: a body provided with an air outlet; an outer air deflector located at the air outlet and used to open and close the air outlet, and formed with a plurality of vent holes penetrating the outer air deflector along a thickness direction; and an inner air deflector located at the air outlet and inside the outer air deflector, and configured to open and cover at least a part of the outer air deflector.

The indoor unit according to the present disclosure, by providing the plurality of vent holes on the outer air deflector, can effectively reduce the air speed and air volume when the airflow is blown out through the vent holes, thereby preventing the airflow being blown directly to persons, so as to achieve the windless effect and improve the user experience.

In some embodiments, the sum of areas of the plurality of vent holes in the outer air deflector is not less than 50% of a total area of the air deflector.

In some embodiments, the vent hole includes a first hole section and a second hole section that are sequentially connected in an air outflow direction, and an outlet size of the first hole section is larger than an inlet size of the second hole section to form a parting surface.

In some embodiments, the first hole section gradually tapers in the air outflow direction, and the second hole section gradually expands in the air outflow direction.

In some embodiments, the parting surface is a plane.

In some embodiments, the vent hole has an inlet area that is no greater than an outlet area thereof.

In some embodiments, a distance between a parting surface and an outlet end of the vent hole is not more than one-half of a total length of the vent hole.

In some embodiments, hole diameters of at least a part of the vent holes are sequentially decreased or increased, or remain unchanged in a direction from top to bottom.

In some embodiments, at least a part of the vent holes are sequentially arranged along a predetermined straight line or curve.

In some embodiments, each vent hole has a diameter in a range of 2 mm to 4 mm.

In some embodiments, an angle between a central axis of the vent hole and the horizontal plane when the outer air deflector is perpendicular to the air outflow direction is in a range of −10° to 10°.

In some embodiments, the outer air deflector is rotatable between a windless state and an open state; the outer air deflector opens the air outlet when in the open state and closes the air outlet when in the windless state.

In some embodiments, the inner air deflector is made of at least one material selected from ordinary ABS, modified ABS, PC, and modified PC.

In some embodiments, the vent hole has a circular, elliptical, triangular or polygonal cross section.

Additional aspects and advantages of the present disclosure will be set forth as described below or be learned through the practices of the present disclosure.

Figure 1:
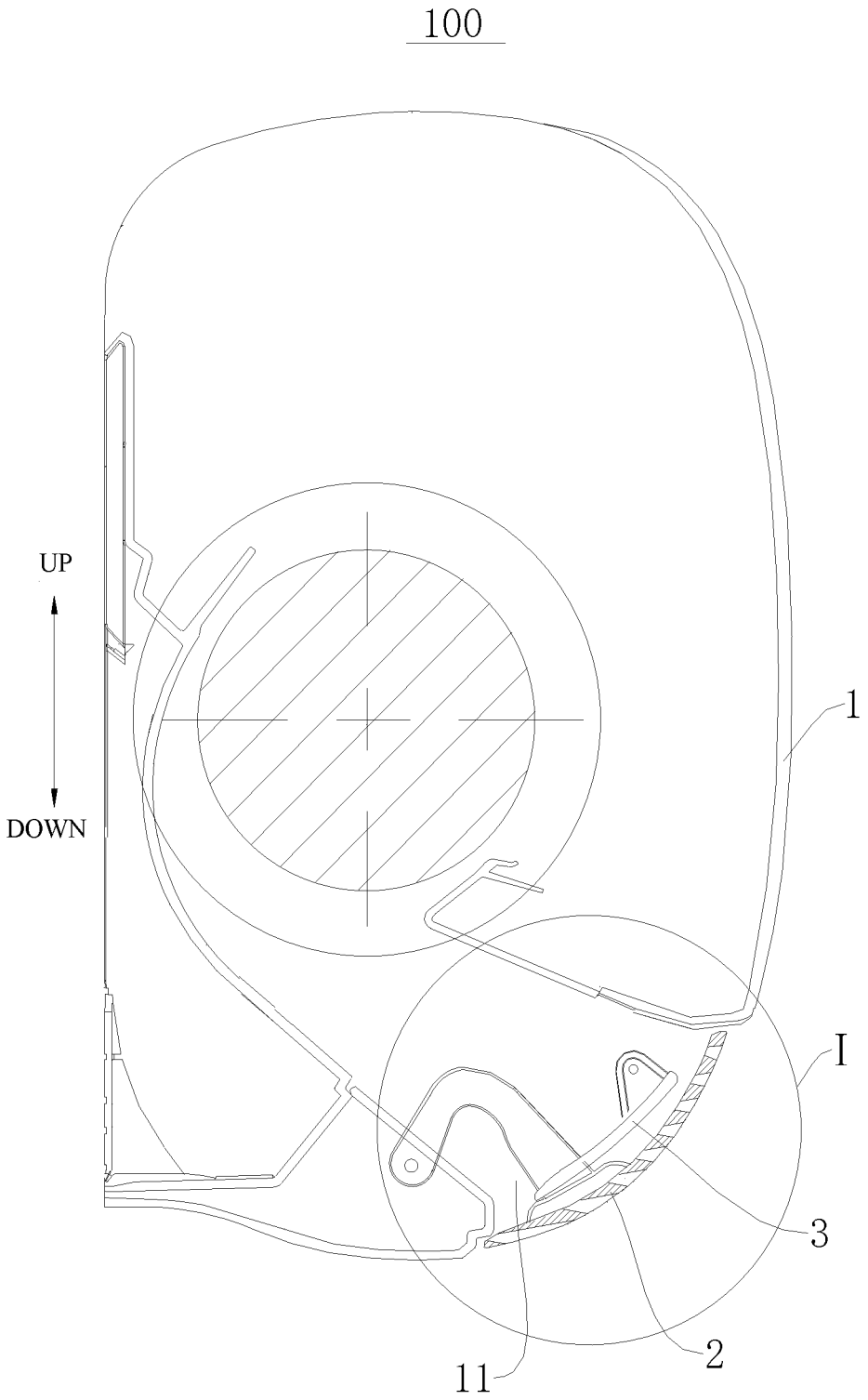
FIG. 1 is a schematic cross-sectional view of an air conditioner indoor unit based on an embodiment of the present disclosure, in which, the outer air deflector closes the air outlet and the inner air deflector covers a portion of the outer air deflector.

REFERENCE NUMERALS air conditioner indoor unit 100,
body 1, air outlet 11,
outer air deflector 2, vent hole 21, first hole section 211, second hole section 212, parting surface 213,
inner air defector 3.

DETAILED DESCRIPTION

The embodiments of the present disclosure are described in detail below, and examples of the embodiments are shown in the attached drawings, throughout which the identical or similar labels are used to denote the identical or similar elements or elements having identical or similar functions. The embodiments described below by reference to the attached drawings are illustrative and are used only to interpret the present disclosure but should not be construed as restrictions on the present disclosure.

An air conditioner indoor unit 100 according to the embodiments of the present disclosure will be described below with reference to FIGS. 1-10. The indoor unit 100 is assembled with an outdoor unit into an air conditioner for adjusting the indoor ambient temperature. The air conditioner may be a split wall-mounted conditioner or an air conditioner with cooling function only or an air conditioner with both cooling and heating functions. In the description of the present disclosure, the air conditioner with both cooling and heating functions is used as an example, and the working modes of the indoor unit 100 comprise windless mode, cooling mode and heating mode.

As shown in FIG. 1, the indoor unit 100 based on the embodiments of the present disclosure comprises: body 1, outer air deflector 2 and inner air deflector 3. All components of the indoor unit 100 can be housed in the body 1. The body 1 not only can support and protect the internal components, but also can realize a certain decorative effect.

The body 1 comprises chassis, face frame and panel, and the face frame is located on the chassis. The front side of the face frame is open, the panel is located at the front side of the face frame, and the air outlet 11 is formed between the lower end of the chassis and the face frame. Specifically, the face frame can be rotated or disassembled on the chassis, and the panel can be rotated or disassembled on the face frame. It can be understood that the body 1 has an air outlet frame for circulating air, and the air conditioner indoor unit further comprises components such as a heat exchanger, a fan, an electric control box, and the like disposed in the body 1.

Specifically, the body 1 has an air outlet 11; the outer air deflector 2 is disposed at the air outlet 11, and the outer air deflector 2 is used to open and close the air outlet 11; for example, the outer air deflector 2 and the edge of the air outlet 11 are pivotally connected to each other, and the air outlet 11 can be opened and closed by rotating the outer air deflector 2. When the outer air deflector 2 opens the air outlet 11, the airflow can blow into the room through the air outlet 11, and the outer air deflector 2 can guide the airflow; and when the outer air deflector 2 closes the air outlet 11, the outer air deflector 2 is parallel and level with the outer edge contour of the body 1.

In some embodiments, during the operation of the indoor unit 100, the outer air deflector 2 can also rotate around the rotation shaft of the outer air deflector 2 to realize the swing.

In some embodiments, a plurality of vent holes 21 are formed on the outer air deflector 2 and extend along the thickness direction of the outer air deflector 2. In some embodiments, the cross section of the vent hole 21 can be circular, elliptical, triangular or polygonal.

Figure 5:
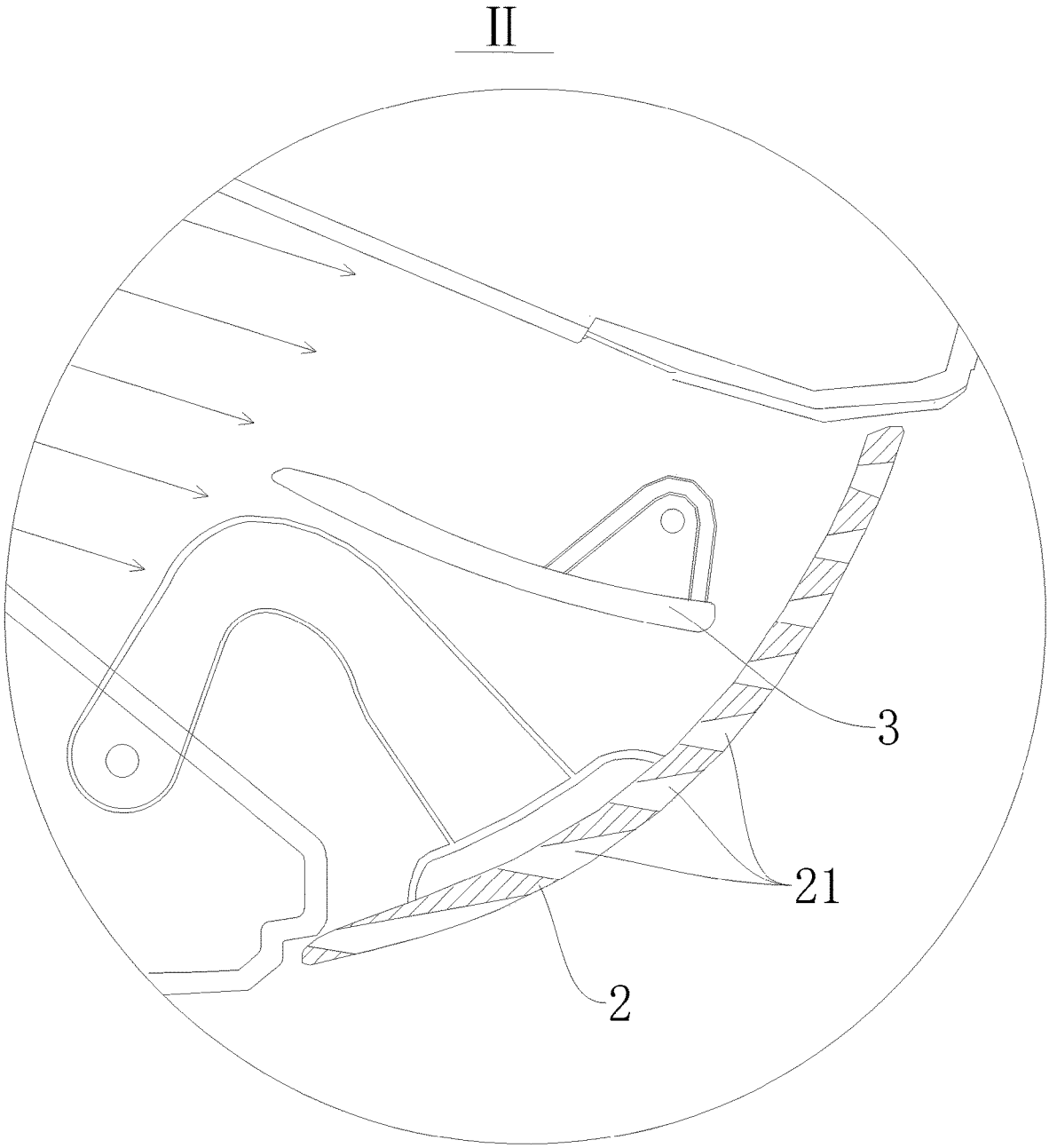
FIG. 5 is an enlarged view of Part II circled in FIG. 4.
Figure 7:
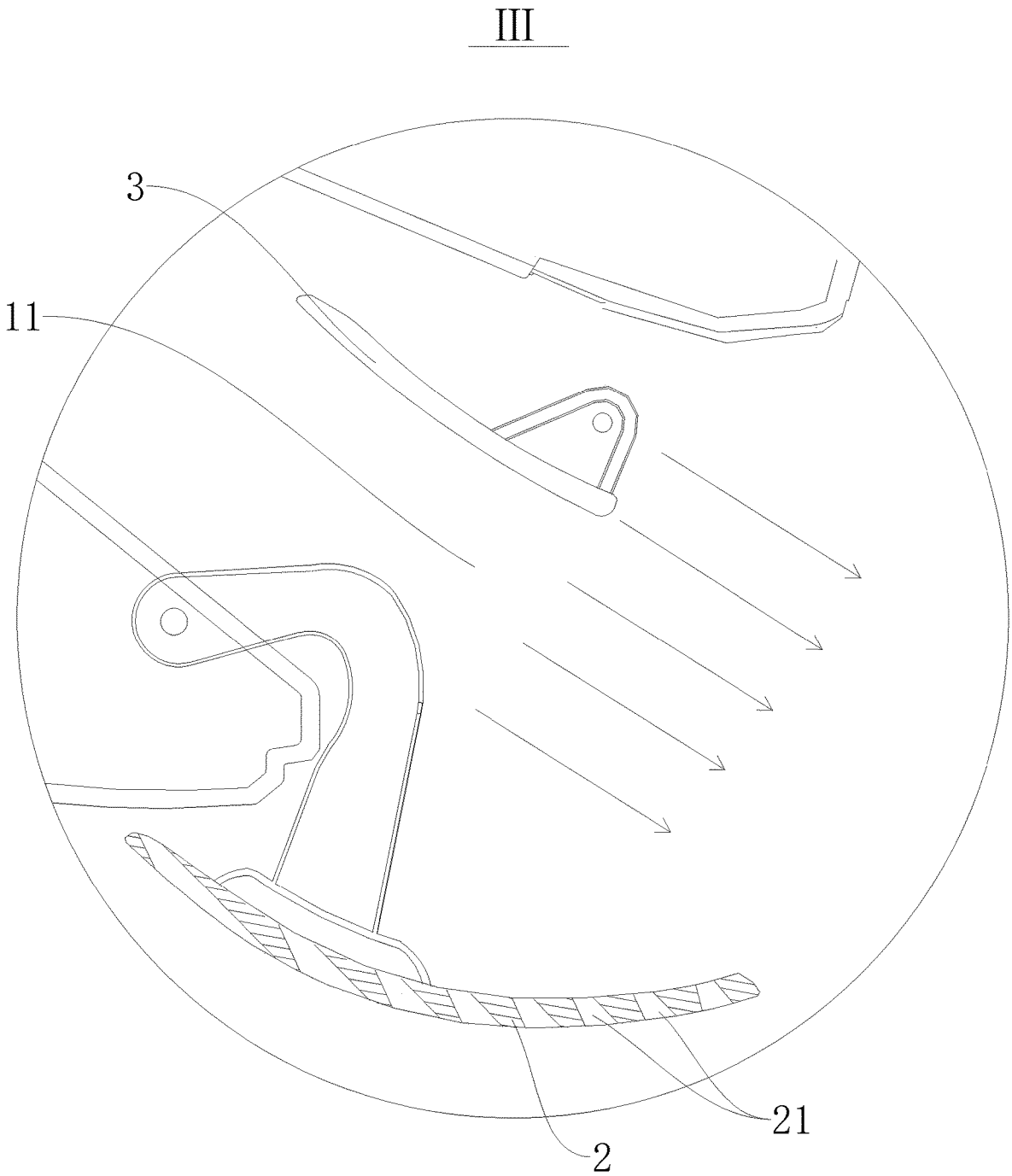
FIG. 7 is an enlarged view of Part III circled in FIG. 6.

Further, the outer air deflector 2 is rotatable between a windless state (for example, the state in which the outer air deflector 2 is as shown in FIG. 5) and an open state (for example, the state in which the outer air deflector 2 is as shown in FIG. 7). The outer air deflector 2 opens the air outlet 11 when it is in an open state, and the outer air deflector 2 closes the air outlet 11 when it is in a windless state.

Figure 4:
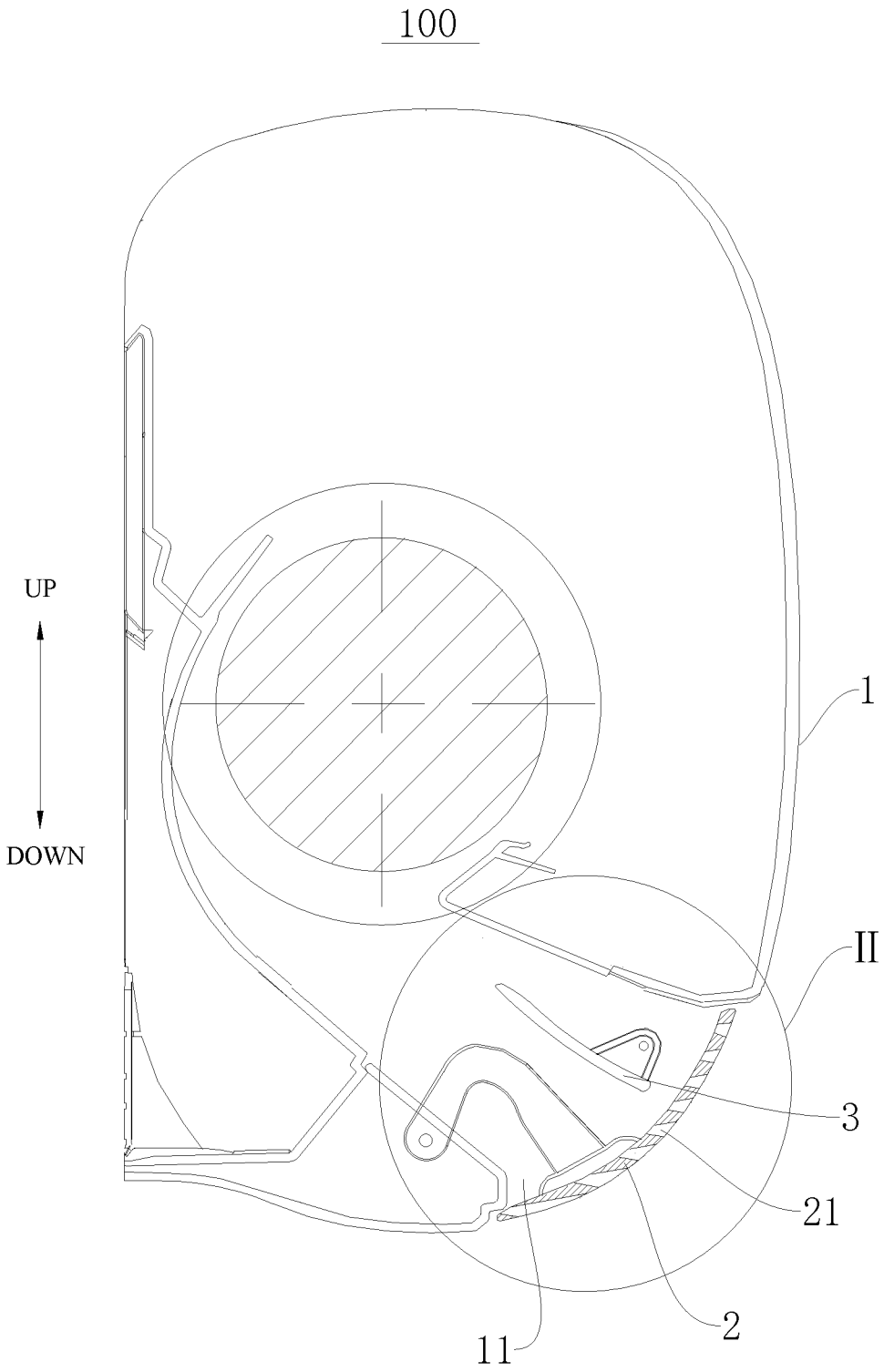
FIG. 4 is a schematic cross-sectional view of an air conditioner indoor unit based on an embodiment of the present disclosure, wherein the outer air deflector closes the air outlet and the inner air deflector does not cover the outer air deflector.

As shown in FIG. 4 and FIG. 5, when the outer air deflector 2 closes the air outlet 11 in the windless state, the airflow in the body 1 can blow through the vent holes 21 on the outer air deflector 2, during which, the air conditioner indoor unit is in a windless mode, and the outer air deflector 2 can block the airflow to some extent, only allowing the airflow to blow out through the vent holes 21, which reduces the wind speed and air volume, achieves the windless effect, effectively avoids air-conditioning diseases caused by direct airflow to people, and make the user experience better. At this time, the air conditioner indoor unit is in the windless mode.

Figure 6:
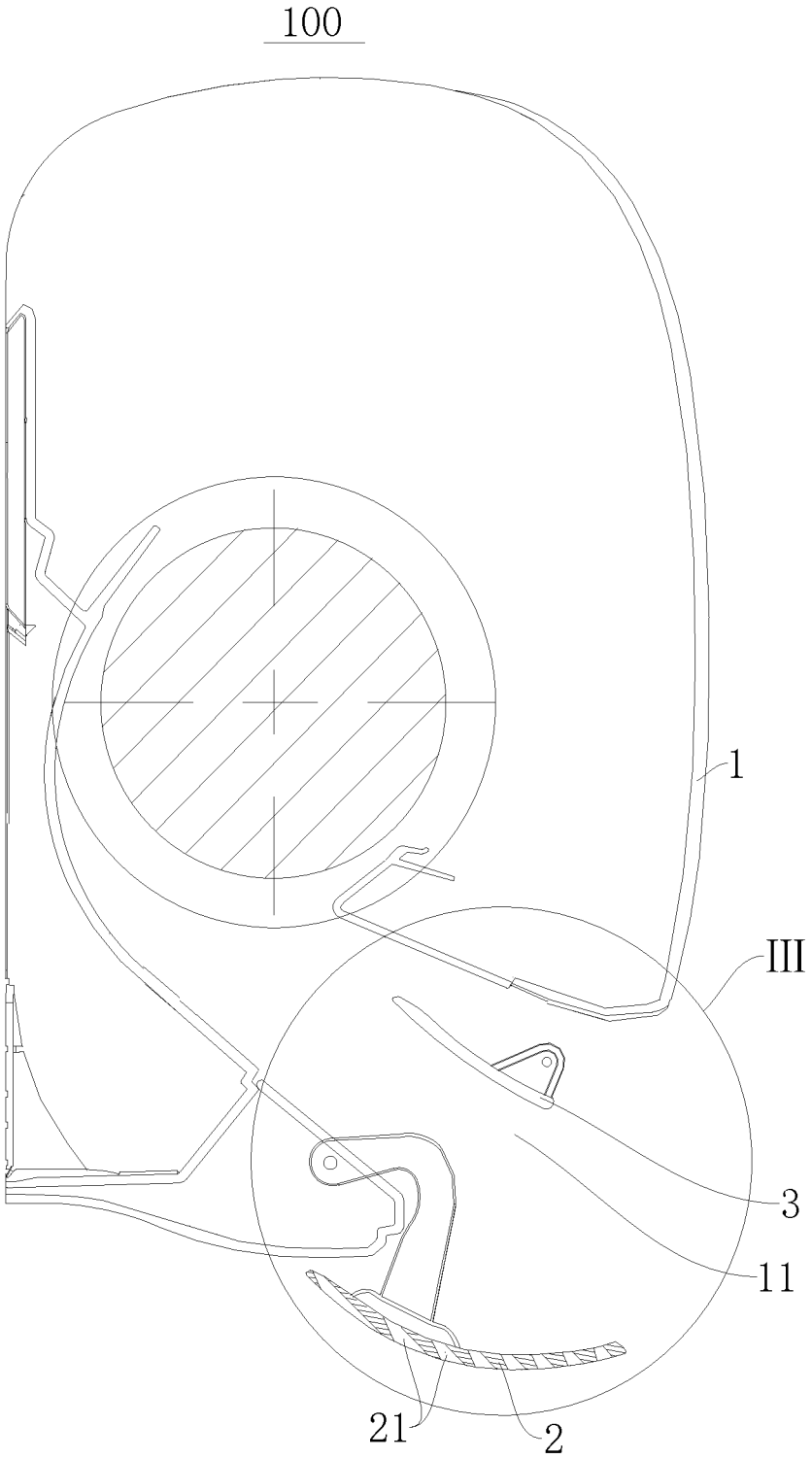
FIG. 6 is a schematic cross-sectional view of an air conditioner indoor unit based on an embodiment of the present disclosure, wherein the outer air deflector opens the air outlet and the inner air deflector does not cover the outer air deflector.

As shown in FIG. 6 and FIG. 7, when the outer air deflector 2 opens the air outlet 11 in the open state, the airflow directly blows out from the air outlet 11, and the air conditioner indoor unit is in the wind-feeling mode.

The inner air deflector 3 is disposed at the air outlet 11 and is located at the inner side of the outer air deflector 2. The inner air deflector 3 is configured to open (expose) and cover at least a portion of the outer air deflector 2. That is, when the outer air deflector 2 closes the air outlet 11, the inner air deflector 3 can expose or cover at least a portion of the outer air deflector 2. For example, the inner air deflector 3 is rotatably disposed at the position of the air outlet 11, and the inner air deflector 3 can be rotated to expose and cover the outer air deflector 2.

Figure 2:
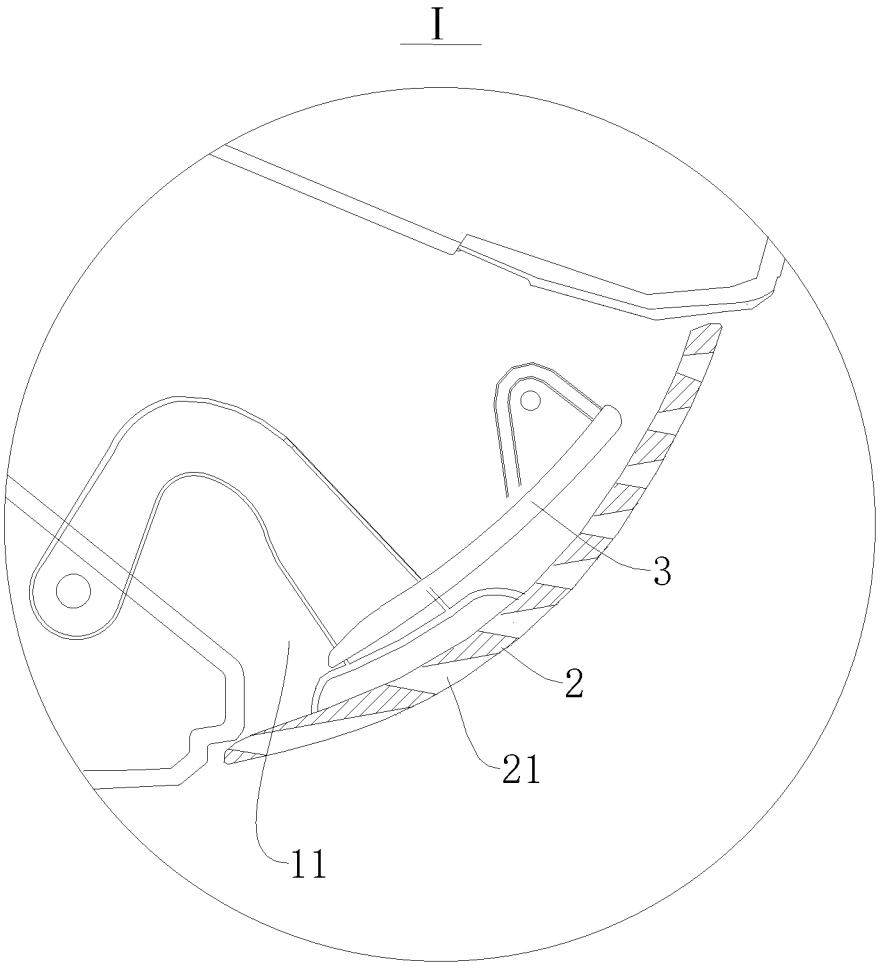
FIG. 2 is an enlarged view of Part I circled in FIG. 1.

Specifically, when the inner air deflector 3 is rotated to be perpendicular to the air outflow direction, as shown in FIG. 2, the inner air deflector 3 may cover at least a portion of the outer air deflector 2; when the inner air deflector 3 is rotated to be parallel to the air outflow direction, as shown in FIG. 5, the inner air deflector 3 exposes, i.e., does not cover, the outer air deflector 2, that is, the inner air deflector 3 does not block the airflow from blowing to the outer wind deflector 2 at this time.

In some embodiments, the inner air deflector 3 can also be rotated around its pivotal axis to realize the wind swinging, that is, to adjust the flow direction of the airflow to the outer wind deflector 2.

The air conditioner indoor unit based on the present disclosure, by providing the plurality of vent holes 21 on the outer air deflector 2, can effectively reduce wind speed and air volume when the airflow comes out through the vent holes 21, which avoid the airflow directly to the human body, achieve the windless effect and improve the user experience.

In one embodiment of the present disclosure, the sum of areas of the plurality of vent holes 21 on the outer air deflector 2 is not less than 50% of the total area of the outer air deflector 2. Thereby, the cooling and heating efficiency can be ensured even with reduced wind speed and air volume.

It should be noted that the total area of the outer air deflector 2 comprises the area of the vent holes 21 on the outer air deflector 2.

Figure 3:
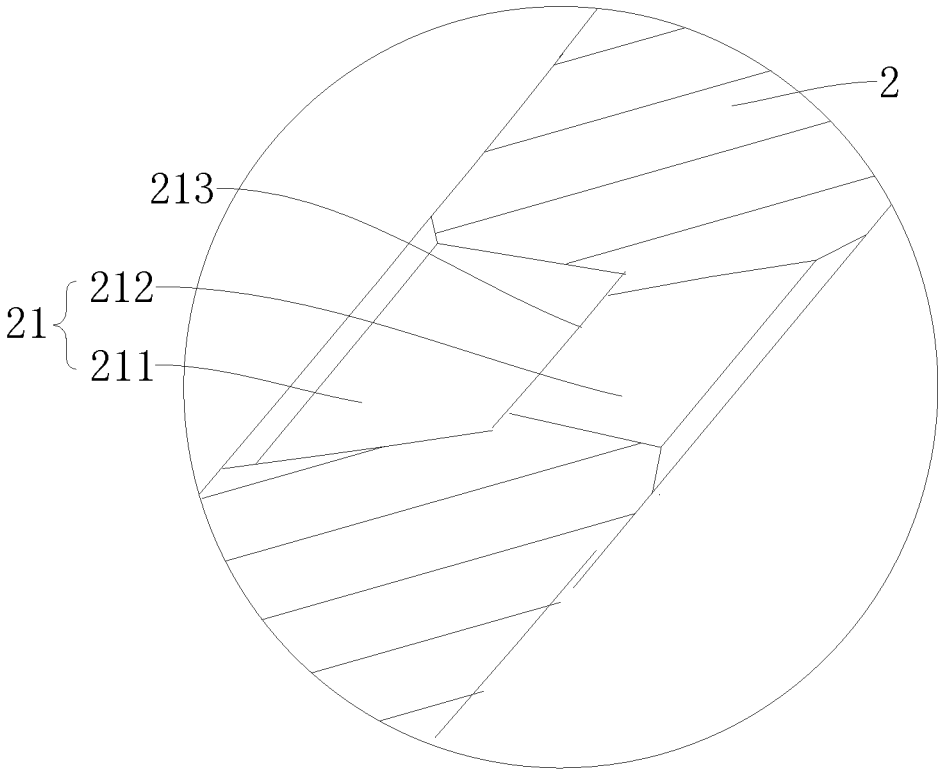
FIG. 3 is a schematic view of vent holes based on some other embodiments of the present disclosure.

In some embodiments of the present disclosure, as shown in FIG. 3, the vent holes 21 may comprise a first hole section 211 and a second hole section 212, and the first hole section 211 and the second hole section 212 are sequentially connected along the air outflow direction (for example, the arrows shown in FIG. 5); the outlet size of the first hole section 211 is larger than the inlet size of the second hole section 212, thereby forming a parting surface 213 at the joint between the first hole section 211 and the second hole section 212. The parting surface 213 can further reduce the wind speed and air volume in the vent holes 21, thus further realizing the windless effect. In addition, the provision of the parting surface 213 also facilitates the formation of vent holes 21, simplifying the structure.

Further, as shown in FIG. 3, the first hole section 211 gradually contracts in the air outflow direction, and the second hole section 212 gradually expands in the same direction. In other words, in the direction of the air supply, the aperture of the first hole section 211 gradually decreases, and the aperture of the second hole section 212 gradually increases, whereby the air volume can be gradually reduced at the first hole section 211, and the flow rate can be gradually reduced at the second hole section 212, which is beneficial to achieve a windless effect.

Optionally, with reference to FIG. 3, the parting surface 213 may be a plane. Thereby, the structure can be simplified, convenient for processing and manufacturing, and at the same time, the effect of reducing the air volume and the flow rate can be achieved.

In some embodiments, as shown in FIG. 2, the inlet area of the vent holes 21 is not greater than the outlet area, e.g., the inlet area of the vent holes 21 may be equal to the outlet area, or the inlet area of the vent holes 21 may be smaller than the outlet area. That makes the flow rate at the outlet of the vent holes 21 not greater than the flow rate at the inlet, so that the flow rate at the outlet of the vent holes 21 is smaller than the flow rate at the inlet, thereby reducing the air volume and the flow rate, and achieving the windless effect.

The present disclosure is not limited thereto, and the inlet area of the vent holes 21 may also be larger than the outlet area so as to reduce the air volume at the outlet.

In some embodiments, as shown in FIG. 3, the distance between the parting surface 213 and the outlet end of the vent hole 21 is not greater than one-half of the total length of the vent hole 21. This helps to further realize the windless effect.

Figure 8:
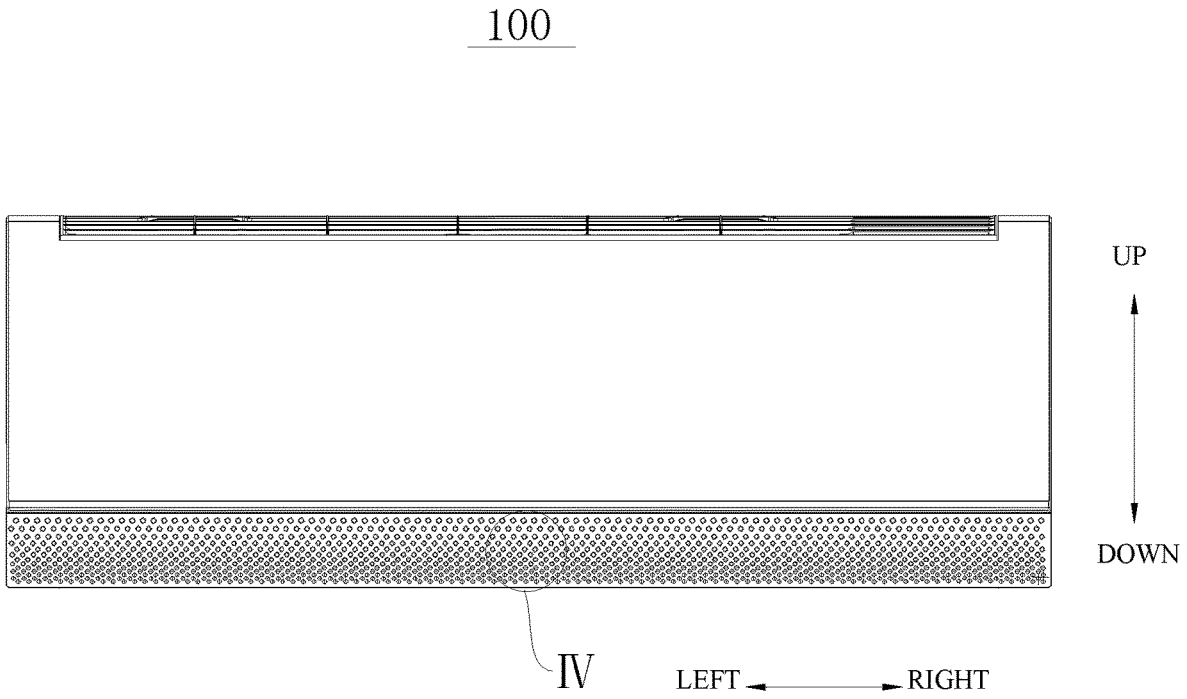
FIG. 8 is a schematic view of an air conditioner indoor unit based on an embodiment of the present disclosure.
Figure 9:
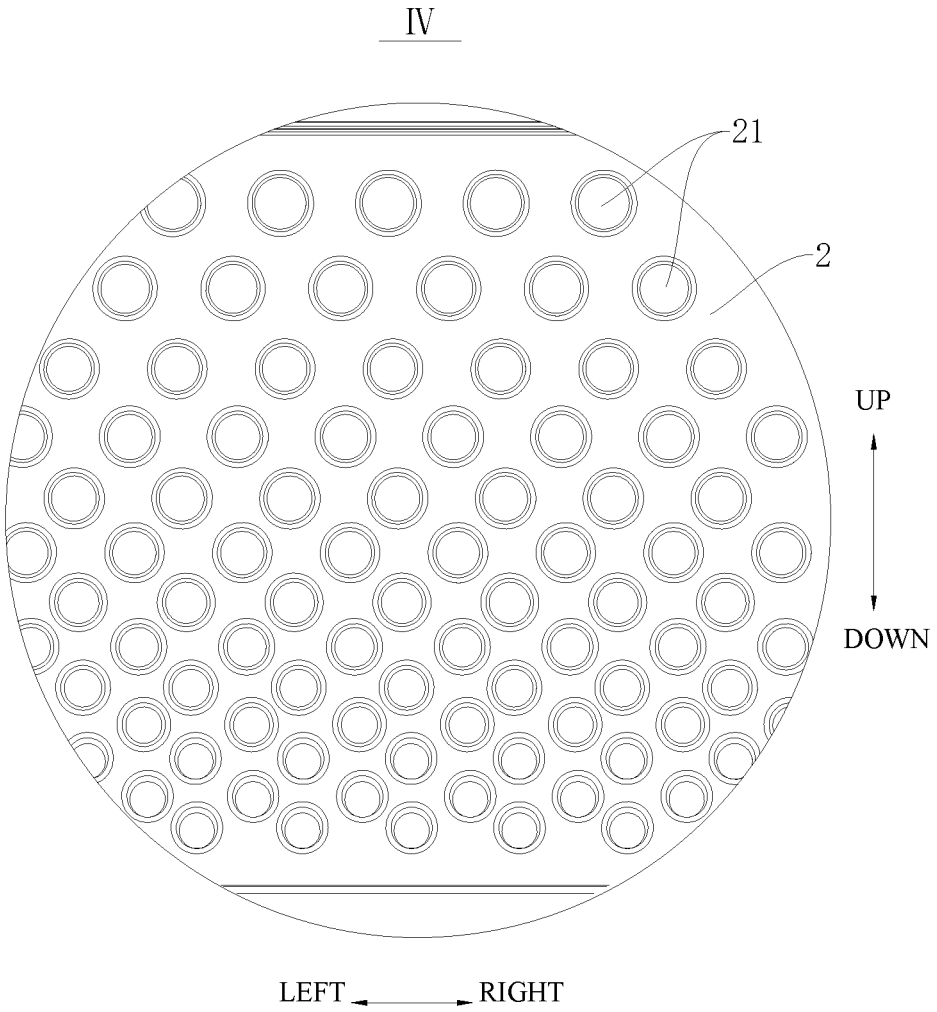
FIG. 9 is an enlarged view of Part IV circled in FIG. 8.
Figure 10:
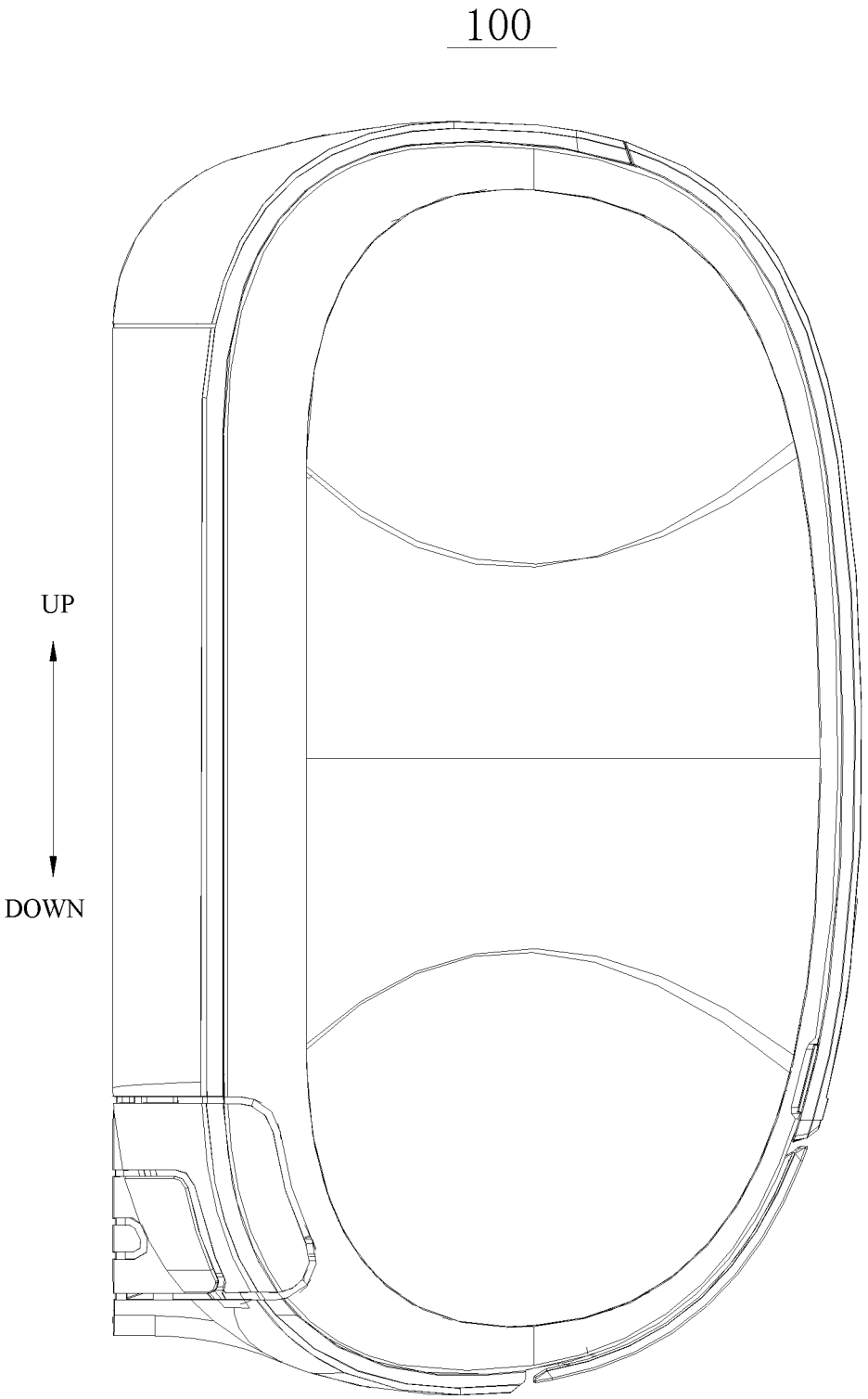
FIG. 10 is a schematic view of the air conditioner indoor unit shown in FIG. 8 from another perspective.

In some embodiments, as shown in FIGS. 8 and 9, at least a part of the plurality of vent holes 21 have sequentially decreasing, sequentially increasing, or unchanged apertures in a direction from top to bottom. That is to say, in the direction from the top to the bottom, the apertures of at least a part of the plurality of vent holes 21 on the outer air deflector 2 may be sequentially decreased, or may be sequentially increased, or the apertures may be uniform (that is, the apertures may remain unchanged). Thereby, the apertures at different positions of the outer air deflector 2 can be set according to different air blowing requirements, so the applicability can be improved.

In some embodiments, as shown in FIGS. 8 and 9, at least a part of the plurality of vent holes 21 may be arranged along a pre-specified straight line, and at least a part of the plurality of vent holes 21 may also be sequentially arranged along a pre-specified curve. Thereby, the positions of the vent holes 21 can be rationally arranged according to the demand, and the appearance can be beautified.

For example, the outer air deflector 2 is provided with multiple rows of vent hole groups arranged at intervals in the longitudinal direction (for example, the left-right direction shown in FIG. 8), and each of the rows of vent holes comprises the plurality of vent holes 21 arranged at intervals in the up and down direction. The plurality of vent holes 21 in the adjacent two rows are staggered in the up and down direction. In addition, the plurality of vent holes 21 in the adjacent two rows may also be arranged in a right-left alignment.

In some embodiments, changing the size of the aperture of the vent holes 21 can change the flow rate and the air volume, which is beneficial to achieve the windless effect. Therefore, in some embodiments, the aperture (e.g., diameter) of the vent holes 21 is in the range of 2 mm to 4 mm, whereby the flow rate and the air volume can be effectively reduced while ensuring the rate of cooling and heating.

As shown in FIG. 2, in some embodiments, when the outer air deflector 2 is perpendicular to the air outflow direction, the angle between the center line of the vent holes 21 and the horizontal plane is in the range of −10 to 10 degrees. In some embodiments, when the outer air deflector 2 is perpendicular to the air outflow direction, the angle between the center line of the vent holes 21 and the horizontal plane is in the range of −5° to 5°. In some embodiments, when the outer air deflector 2 is perpendicular to the air outflow direction, the center line of the vent hole 21 is approximately parallel to the horizontal plane. Thereby, the air can flow out in a approximately horizontal direction to prevent the air from directly flowing to the human body, thereby improving the user experience.

In some embodiments, the inner air deflector 3 is made of at least one of ordinary ABS (acrylonitrile-styrene-butadiene copolymer), modified ABS, PC (polycarbonate), or modified PC.

In some embodiments, the outer air deflector 2 is made of at least one of ordinary ABS (acrylonitrile-styrene-butadiene copolymer), modified ABS, PC (polycarbonate), or modified PC.

The working process of the indoor unit 100 based on embodiments of the present disclosure is described below.

The indoor unit 100 based on the embodiments of the present disclosure can work in a windless mode, a cooling wind mode, or a heating wind mode. When the indoor unit 100 is working, the air conditioner indoor unit is turned on and a selection of an air outflow mode is received.

When the windless mode is selected, the outer air deflector 2 is turned to close the air outlet 11, and the inner air deflector 3 rotates to be parallel to the air outlet direction; at this time, the air in the body 1 flows out from the plurality of vent holes 21. As such, the flow rate is reduced, and the windless effect is achieved.

When the cooling wind mode or the heating wind mode is selected, the outer air deflector 2 opens the air outlet 11, and the inner air deflector 3 rotates to be substantially parallel to the air outflow direction.

In the description of the present disclosure, it should be understood that the orientation or position relations indicated with the terms "center," "longitudinal," "horizontal," "length," "width," "thickens," "up," "down," "front," "back," "left," "right," "vertical," "lateral," "top," "bottom," "inner," "outer," "axial," "radial," "circumferential" and the like are based on the orientation or position relationships shown in the attached drawings, are used only for the convenience of describing the present disclosure and simplifying the description, rather than indicating or implying that the device or element referred to must have a particular orientation, be constructed and operated in a particular orientation, so they shall not be construed as a restriction on the present disclosure.

In addition, the terms "first" or "second" are used for descriptive purposes only and are not to be construed as indicating or implying a relative importance or implicitly indicating the number of technical features indicated. Therefore, a feature associated with "first" or "second" may, explicitly or implicitly, comprise one or more such features. Unless otherwise stated, the term "a plurality of" means two or more in the description of the present disclosure.

In the description of the present disclosure, it should be noted that unless otherwise expressly specified and defined, the terms "installation," "linking," "connection" and "fixing" shall be understood generally; for example, it may be fixed connection, detachable connection, or integral connection; mechanical or electrical connections or communication; or direct linking, indirect linking through an intermediate medium, or internal connection of two components or interactive relationship between them. The specific meaning of the above terms in the present disclosure may be understood on a case by case basis by ordinary technical personnel in the field.

In the description of the present disclosure, the terms "one embodiment," "some embodiments" "example" "specific embodiment" or "some examples" etc. mean that the specific feature, structure, material or characteristic of that embodiment or example described are comprised in at least one embodiment or example of the present disclosure. In this description, the schematic presentation of such terms may not refer to the same embodiment or example. Moreover, the specific features, structure, material or characteristics described may be combined in an appropriate manner in any one or multiple embodiments or examples. In addition, different embodiments or examples described in this specification, as well as features of these embodiments or examples, may be integrate and combined by ordinary technical personnel in the field without departing from the scope of the present disclosure.

Although the embodiments of the present disclosure have been presented and described, the ordinary technical personnel in the field can understand that various changes, modifications, substitutions and variations of such embodiments can be made without deviating from the principles and purposes of the present disclosure, and that the scope of the invention is defined by the claims and their equivalents.

What is claimed is:

1. An air conditioner indoor unit comprising:

a body including an air outlet;

an outer air deflector located at the air outlet and configured to open and close the air outlet, the outer air deflector including a plurality of vent holes penetrating the outer air deflector along a thickness direction of the outer air deflector; and an inner air deflector located upstream of the outer air deflector along an air outflow direction, and configured to rotate between a first position and a second position;

wherein when the outer air deflector closes the air outlet:

the inner air deflector at the first position is approximately parallel to the outer air deflector and covers at least part of the plurality of vent holes of the outer air deflector from an upstream side of the at least part of the plurality of vent holes along the air outflow direction; and the inner air deflector at the second position is approximately perpendicular to the outer air deflector and exposes the outer air deflector; and a first included angle between the outer air deflector and the inner air deflector at the first position is different from a second included angle between the outer air deflector and the inner air deflector at the second position.

2. The indoor unit according to claim 1, wherein a sum of areas of the plurality of vent holes is not less than 50% of a total area of the outer air deflector.

3. The indoor unit according to claim 1, wherein one of the vent holes includes a first hole section and a second hole section that are sequentially connected in the air outflow direction.

4. The indoor unit according to claim 3, wherein an outlet size of the first hole section is larger than an inlet size of the second hole section, a parting surface being formed between the first hole section and the second hole section.

5. The indoor unit according to claim 4, wherein the parting surface is a plane.

6. The indoor unit according to claim 4, wherein a distance between the parting surface and an outlet end of the vent hole is not more than one-half of a total length of the vent hole.

7. The indoor unit according to claim 3, wherein the first hole section gradually tapers in the air outflow direction, and the second hole section gradually expands in the air outflow direction.

8. The indoor unit according to claim 1, wherein one of the vent holes has an inlet area and an outlet area, the inlet area being no greater than the outlet area.

9. The indoor unit according to claim 8, wherein the inlet area is smaller than the outlet area.

10. The indoor unit according to claim 1, wherein hole diameters of a part of the vent holes sequentially decrease, increase, or remain unchanged in a direction from a top of the outer air deflector to a bottom of the outer air deflector.

11. The indoor unit according to claim 1, wherein a part of the vent holes are sequentially arranged along a straight line or a curve.

12. The indoor unit according to claim 1, wherein one of the vent holes has a hole diameter ranging from 2 mm to 4 mm.

13. The indoor unit according to claim 1, wherein an angle between a central axis of one of the vent holes and a horizontal plane when the outer air deflector is perpendicular to the air outflow direction ranges from −10° to 10°.

14. The indoor unit according to claim 1, wherein the outer air deflector is rotatable between a windless state in which the outer air deflector opens the air outlet and a windless state in which the outer air deflector closes the air outlet.

15. The indoor unit according to claim 1, wherein the inner air deflector is made of at least one of ordinary acrylonitrile-styrene-butadiene copolymer (ABS), modified ABS, polycarbonate (PC), or modified PC.

16. The indoor unit according to claim 1, wherein the outer air deflector is made of at least one of ordinary acrylonitrile-styrene-butadiene copolymer (ABS), modified ABS, polycarbonate (PC), or modified PC.

17. The indoor unit according to claim 1, wherein one of the vent holes has a circular, elliptical, triangular, or polygonal cross section.

* * * * *